US008888065B2

(12) United States Patent
Logan

(10) Patent No.: US 8,888,065 B2
(45) Date of Patent: Nov. 18, 2014

(54) TROLLING MOTOR STABILIZER MOUNT

(71) Applicant: Dennis M. Logan, Brunswick, OH (US)

(72) Inventor: Dennis M. Logan, Brunswick, OH (US)

( * ) Notice: Subject to any disclaimer, the term of this patent is extended or adjusted under 35 U.S.C. 154(b) by 0 days.

(21) Appl. No.: 13/746,781

(22) Filed: Jan. 22, 2013

(65) Prior Publication Data

US 2014/0203162 A1 Jul. 24, 2014

(51) Int. Cl.
*F16M 1/00* (2006.01)
*B63H 20/06* (2006.01)

(52) U.S. Cl.
CPC ..... *B63H 20/06* (2013.01)
USPC ..... 248/640; 248/642; 248/351; 248/354.1; 440/53

(58) Field of Classification Search
USPC ..... 248/640, 641, 642, 643, 351, 354.5, 248/354.1, 354.4; 440/55, 113, 53
See application file for complete search history.

(56) References Cited

U.S. PATENT DOCUMENTS 3,765,369 A * 10/1973 Henning ..... 440/55
3,861,628 A 1/1975 Krieger
3,941,344 A * 3/1976 Paterson ..... 248/351
3,952,986 A * 4/1976 Wells ..... 248/354.4
3,999,500 A 12/1976 Friedel et al.
4,008,680 A 2/1977 Alexander, Jr.
4,501,561 A * 2/1985 Speelman ..... 440/61 R
4,555,233 A 11/1985 Klammer et al.
4,650,427 A * 3/1987 Huchinson ..... 440/55
4,685,888 A * 8/1987 Brewer ..... 440/53
4,819,905 A 4/1989 McCain
4,828,186 A * 5/1989 Weiss ..... 248/640
4,875,656 A 10/1989 Boede
4,966,566 A 10/1990 Baird
5,002,509 A 3/1991 Uroszek
5,021,016 A * 6/1991 Currey ..... 440/113
5,031,842 A * 7/1991 Mohr ..... 248/640
5,116,267 A 5/1992 Olson
5,340,077 A 8/1994 Tyler
5,405,274 A 4/1995 Cook, III
5,941,742 A 8/1999 Whitaker
6,076,796 A * 6/2000 Huggins et al. ..... 248/640
6,224,437 B1 5/2001 Griffith, Sr. et al.
6,254,441 B1 7/2001 Knight et al.
6,394,408 B1 5/2002 Henderson et al.
6,447,350 B2 * 9/2002 Thompson et al. ..... 440/55
6,524,144 B2 2/2003 Pasley
6,808,431 B1 10/2004 Neely
6,978,570 B1 12/2005 Clark et al.
7,240,885 B1 * 7/2007 Sullivan ..... 248/354.1
7,303,595 B1 12/2007 Janitz
D594,034 S 6/2009 Bernloehr et al.
7,556,545 B2 * 7/2009 Draghici ..... 440/55
2001/0044243 A1 * 11/2001 Thompson et al. ..... 440/55
2002/0152940 A1 10/2002 King
2008/0029683 A1 * 2/2008 Draghici ..... 248/640
2009/0191773 A1 7/2009 Lloyd
2010/0055999 A1 3/2010 Wright et al.
2013/0221187 A1 * 8/2013 Marks et al. ..... 248/640

* cited by examiner

*Primary Examiner* — Bradley Duckworth
(74) *Attorney, Agent, or Firm* — Fay Sharpe LLP

(57) ABSTRACT

This disclosure is generally related to a support device for a trolling motor while in a retracted position. More specifically, this disclosure provides a trolling motor stabilizer mount for reducing vibration and bouncing of a trolling motor shaft/arm while a boat is underway.

20 Claims, 13 Drawing Sheets

TROLLING MOTOR STABILIZER MOUNT

BACKGROUND

This disclosure is generally related to a support device for a trolling motor shaft while the trolling motor is in a retracted position. More specifically, this disclosure provides a trolling motor stabilizer mount for reducing vibration and bouncing of a trolling motor shaft/arm while a boat is underway or being transported by trailer, etc.

U.S. Pat. No. 3,861,628, which issued to Krieger on Jan. 21, 1975, describes a folding accessory bracket assembly that is particularly adapted for mounting a trolling motor so as to automatically position the accessory vertically in the water in an extended position and parallel to and on top of the boat deck in a retracted position. The bracket assembly generally comprises a mounting means attached to the boat deck and an accessory bracket for mounting to the accessory. Arm means are pivotally mounted between the mounting means and the accessory bracket for automatically positioning the accessory bracket as the arm means are pivoted, to thereby properly position the accessory in the extreme positions.

U.S. Pat. No. 3,999,500, which issued to Friedel et al. on Dec. 28, 1976, describes a pivotal support lock apparatus for trolling motor apparatus. The mount for a trolling motor includes a deck bracket having a housing arm pivotally mounted at one end. A gear mechanism within the arm has a fixed bevel gear on the pivot arm axis meshing with a bevel gear in a rotatable torque tube. A drive bevel gear is secured to the opposite end and meshes with a gear sector on a coupling head pivotally mounted in the outer end of the arm.

U.S. Pat. No. 4,008,680, which issued to Alexander on Feb. 22, 1977, discloses a pivotal mount assembly for trolling motors. The mount includes a deck bracket having a housing arm pivotally mounted at one end. A gear mechanism within the arm has a fixed bevel gear on the pivot arm axis meshing with a bevel gear on a rotatable torque tube. A drive bevel gear is secured to the opposite end and meshes with a gear sector on a coupling head pivotally mounted in the outer end of the arm. The head includes a swivel support within which a trolling motor unit is rotatably mounted.

U.S. Pat. No. 4,819,905, which issued to McCain on Apr. 11, 1989, describes a trolling motor mount for pleasure boats. An adjustable bracket mounting support for mounting an electric trolling motor on the forward end of a pleasure boat is described. It includes a base member supported by two adjustable length arms which are attached to slidable clamps mounted on the bow rails of the boat and a downwardly extending support leg which attaches to the bow eye of the boat. A motor mount plate is rotatably mounted on the base plate and is adapted for receiving the mounting bracket assembly of a remotely controlled electric trolling motor.

U.S. Pat. No. 4,875,656, which issued to Boede on Oct. 24, 1989, discloses a stowable pull handle for electric trolling motor support apparatus. A manual operating cord for a deck-mounted electric trolling motor includes a handle which is demountably attachable to an arm of the pivotal motor support apparatus when the motor is in the operative or stowed position. The demountable handle assures that the operating cord will always be readily accessible to the operator in the boat to either raise the motor from its operative position or lower it thereto from its stowed position on the deck. The handle is demountably secured to one of the pivot arms of the motor support apparatus by frictional engagement between the legs of an elongated U-shaped slot in the handle and the lateral faces of the pivot arm.

U.S. Pat. No. 5,002,509, which issued to Uroszek on Mar. 26, 1991, describes a trolling motor mount. The mount is for use in mounting an outboard trolling motor on the outboard drive unit of a boat equipped with an inboard/outboard type power unit. The motor mount includes a mounting block for supporting an outboard trolling motor and a support structure attachable to the outboard drive unit through the drive unit's top cover for supporting the mounting block to one side of the drive unit at a location behind the boat's transom.

U.S. Pat. No. 5,116,267, which issued to Olson on May 26, 1992, describes a yieldable protective mount for trolling motors. The mounting mechanism incorporates a mounting base that is fixed to the deck structure or the stern structure of a small boat such as is typically used for recreational activities such as fishing. A motor support element is pivotally connected by hinge structure to the base and is continuously urged by tension springs to an operating position where the trolling motor is positioned for its normal operation.

U.S. Pat. No. 5,340,077, which issued to Tyler on Aug. 23, 1994, discloses a trolling motor anti-bounce mechanism. It allows fisherman to easily stow the trolling motor and control housing while assuring that damage to the mounting bracket, the trolling motor, and the control housing is minimized. The lower arm of the mounting bracket is secured to the boat. The upper arm of the mounting bracket forms a cantilever that projects from a pivot point. Stress forces will most likely cause metal fatigue to occur on the flange called the "positive stow lock feature" near the pivot point. Shock to the positive stow lock feature is minimized by provision of a rubber-based leg to stabilize the upper arm of the mounting bracket. The suspension of the trolling motor and the control housing limits their downward travel.

U.S. Pat. No. 6,224,437, which issued to Griffith et al. on May 1, 2001, describes a trolling motor mount stabilizer. The assembly includes a bracket adapted to support the trolling motor. A pivoting member, such as a link or an arm, has a first end pivotally coupled to the bracket. The pivoting member is also pivotally coupled to an abutment adjacent a boat deck or gunwale at its second end. A support member is rigidly affixed to a surface of the bracket such that the support member sustains the overhung load of the trolling motor while it is in the stowed position on the boat deck or gunwale. The support member is flat and unobtrusive when the motor is in its run position.

U.S. Pat. No. 6,254,441, which issued to Knight et al. on Jul. 3, 2001, describes a trolling motor propulsion unit support shaft. The system includes a lower propulsion unit, a mounting mechanism adapted to be coupled to the boat and a first shaft fitting at least partially between the mounting mechanism and the lower propulsion unit. The first shaft has a non-circular cross-sectional shape. In one embodiment, the mounting mechanism is configured to mount to a boat having a longitudinal axis extending from a bow to a stern of the boat, wherein the first shaft has a longitudinal length and smaller transverse width.

U.S. Pat. No. 6,394,408, which issued to Henderson et al. on May 28, 2002, discloses a trolling motor column mounting system. The trolling motor column is supported in a support frame by virtue of the ball and socket connection. The column passes through the ball. The ball has a bore through which the column extends. The column may be secured in different positions to the bore or a tube which extends from the bore in the ball.

U.S. Pat. No. 6,808,431, which issued to Neely on Oct. 26, 2004, describes a trolling motor mount tool. The tool is intended to assist in the moving of a trolling motor support mount between a lowered position and a raised position. The trolling motor mount tool includes a main member having a first cutout and a second cutout, a first arm pivotally attached to the main member, wherein the first arm includes an engaging tube, and a second arm pivotally attached to the main member having an arm cutout. The user utilizes the first cutout and an arm cutout to engage the locking pin of a motor mount for a trolling motor. The user utilizes the second cutout and the engaging tube of the first arm to engage the locking pin of the motor mount.

When a trolling motor is in a stowed position, the extendable shaft/arm is typically supported, in a cantilever condition, slightly above the deck of the boat. As the boat moves in response to waves, or while being towed on a trailer, movement of the boat can cause the cantilever arm to move upwardly and downwardly relative to the surface of the boat deck. This movement of the trolling motor can induce stress on the components of the trolling motor and, in certain instances, can cause annoying impact noises if the cantilevered arm of the trolling motor repeatedly strikes the deck surface. It would therefore be beneficial if a component could be provided that cushions and supports the trolling motor shaft/arm of the trolling motor in relation to the deck surface of a boat.

INCORPORATION BY REFERENCE

U.S. Design Pat. No. D594,034, by Bernloehr et al., issued Jun. 9, 2009 and entitled "TROLLING MOTOR MOUNT";

U.S. Patent Publication No. 2010/0055999, by Wright et al., published Mar. 4, 2010 and entitled "VIBRATION DAMPER FOR AN ELECTRIC TROLLING MOTOR";

U.S. Patent Publication No. 2009/0191773, by Lloyd, published Jul. 30, 2009 and entitled "METHOD AND APPARATUS FOR ABSORBING, DAMPENING AND/OR REDUCING SOUNDS AND VIBRATIONS CREATED BY THE USE OF AN ELECTRIC TROLLING MOTOR; WHICH AT THE SAME TIME PROTECTS THE TROLLING MOTOR AGAINST DAMAGE BY DAMPENING FORCE AND/OR SOUNDS FROM EXTERNAL TRAUMA";

U.S. Patent Publication No. 2002/0152940, by King, published Oct. 24, 2002 and entitled "TROLLING MOTOR MOUNT ASSEMBLY";

U.S. Pat. No. 7,303,595, by Janitz, issued Dec. 4, 2007 and entitled "IMPACT ABSORBING ISOLATOR SLEEVE AND ASSEMBLY FOR MOUNTING A TROLLING MOTOR";

U.S. Pat. No. 6,978,570, by Clark et al., issued Dec. 27, 2005 and entitled "ADJUSTABLE SWIVEL BASE";

U.S. Pat. No. 6,808,431, by Neely, issued Oct. 26, 2004 and entitled "TROLLING MOTOR MOUNT TOOL";

U.S. Pat. No. 6,524,144, by Pasley, issued Feb. 25, 2003 and entitled "SPRING ASSEMBLY FOR TROLLING MOTOR BRACKET";

U.S. Pat. No. 6,394,408, by Henderson et al., issued May 28, 2002 and entitled "TROLLING MOTOR COLUMN MOUNTING SYSTEM";

U.S. Pat. No. 6,254,441, by Knight et al., issued Jul. 3, 2001 and entitled "TROLLING MOTOR PROPULSION UNIT SUPPORT SHAFT";

U.S. Pat. No. 6,224,437, by Griffith, Sr. et al., issued May 1, 2001 and entitled "TROLLING MOTOR MOUNT STABILIZER";

U.S. Pat. No. 5,941,742, by Whitaker, issued Aug. 24, 1999 and entitled "TROLLING MOTOR MOUNT";

U.S. Pat. No. 5,405,274, by Cook, Ill., issued Apr. 11, 1995 and entitled "TROLLING MOTOR MOUNT CLUTCH SLIP-JOINT";

U.S. Pat. No. 5,340,077, by Tyler, issued Aug. 23, 1994 and entitled "TROLLING MOTOR ANTI-BOUNCE MECHANISM";

U.S. Pat. No. 5,116,267, by Olson, issued May 26, 1992 and entitled "YIELDABLE PROTECTIVE MOUNT FOR TROLLING MOTORS";

U.S. Pat. No. 5,002,509, by Uroszek, issued Mar. 26, 1991 and entitled "TROLLING MOTOR MOUNT";

U.S. Pat. No. 4,966,566, by Baird, issued Oct. 30, 1990 and entitled "RAISING AND LOWERING AID FOR TROLLING MOTORS";

U.S. Pat. No. 4,875,656, by Boede, issued Oct. 24, 1989 and entitled "STOWABLE PULL HANDLE FOR ELECTRIC TROLLING MOTOR SUPPORT APPARATUS";

U.S. Pat. No. 4,819,905, by McCain, issued Apr. 11, 1989 and entitled "TROLLING MOTOR MOUNT FOR PLEASURE BOATS";

U.S. Pat. No. 4,555,233, by Klammer et al., issued Nov. 26, 1985 and entitled "SHOCK-ABSORBING BOW MOUNT FOR TROLLING MOTOR";

U.S. Pat. No. 4,008,680, by Alexander, Jr., issued Feb. 22, 1977 and entitled "PIVOTAL MOUNT ASSEMBLY FOR TROLLING MOTORS";

U.S. Pat. No. 3,999,500, by Friedel et al., issued Dec. 28, 1976 and entitled "PIVOTAL SUPPORT LOCK APPARATUS FOR TROLLING MOTOR APPARATUS";

U.S. Pat. No. 3,861,628, by Krieger, issued Jan. 21, 1975 and entitled "FOLDING ACCESSORY BRACKET ASSEMBLY", are hereby expressly incorporated herein by reference in their entirety.

BRIEF DESCRIPTION

In one embodiment of this disclosure, described is a trolling motor stabilizer mount comprising a trolling motor shaft support including a first longitudinal end, and a second longitudinal end defined by a longitudinal axis passing through the first and second longitudinal ends, the first longitudinal end adapted to mount to a boat and the second longitudinal end adapted to provide a rest for a shaft associated with a retracted trolling motor including a retractable mount independent of the trolling motor shaft support; and a spring loaded clamp operatively associated with the shaft support second longitudinal end and adapted to releasably engage the shaft associated with the retracted trolling motor, the spring loaded clamp including a spring axially aligned along the shaft support longitudinal axis.

In another embodiment of this disclosure, described is a trolling motor stabilizer mount comprising a trolling motor shaft support including a first longitudinal end, and a second longitudinal end defined by a longitudinal axis passing through the first and second longitudinal ends, the first longitudinal end adapted to mount to a boat and the second longitudinal end adapted to provide a rest for a shaft associated with a retracted trolling motor including a retractable mount independent of the trolling motor shaft support; and, the trolling motor shaft support including a main block operatively associated with the trolling motor shaft support, the main block including a clamp hook hole; a vee block attached to the main block to provide the second longitudinal end of the support, and the vee block adapted to provide a substantially v shaped rest for the shaft associated with the retracted trolling motor; a spring loaded clamp operatively associated with the shaft support second longitudinal end and adapted to releasably engage the shaft associated with the retracted trolling motor, the spring loaded clamp including a spring axially aligned along the shaft support longitudinal axis, wherein the spring is aligned parallel and offset to the shaft support longitudinal axis, the spring loaded clamp including a spring; a clamp hook including a shaft extending through the clamp hook hole and the spring, and a fastener attached to the clamp hook shaft to hold the spring at a desired position; and a spring tube adapted to cover the spring, clamp hook shaft and fastener, wherein the clamp hook hole and the spring tube are attached by threads, the vee block is made of a plastic material, and the clamp hook includes a top curved piece and a bottom curved piece associated with the clamp hook shaft, and the clamp hook is liftable and rotatable 360° independent from the trolling motor support.

DETAILED DESCRIPTION

Figure 1:
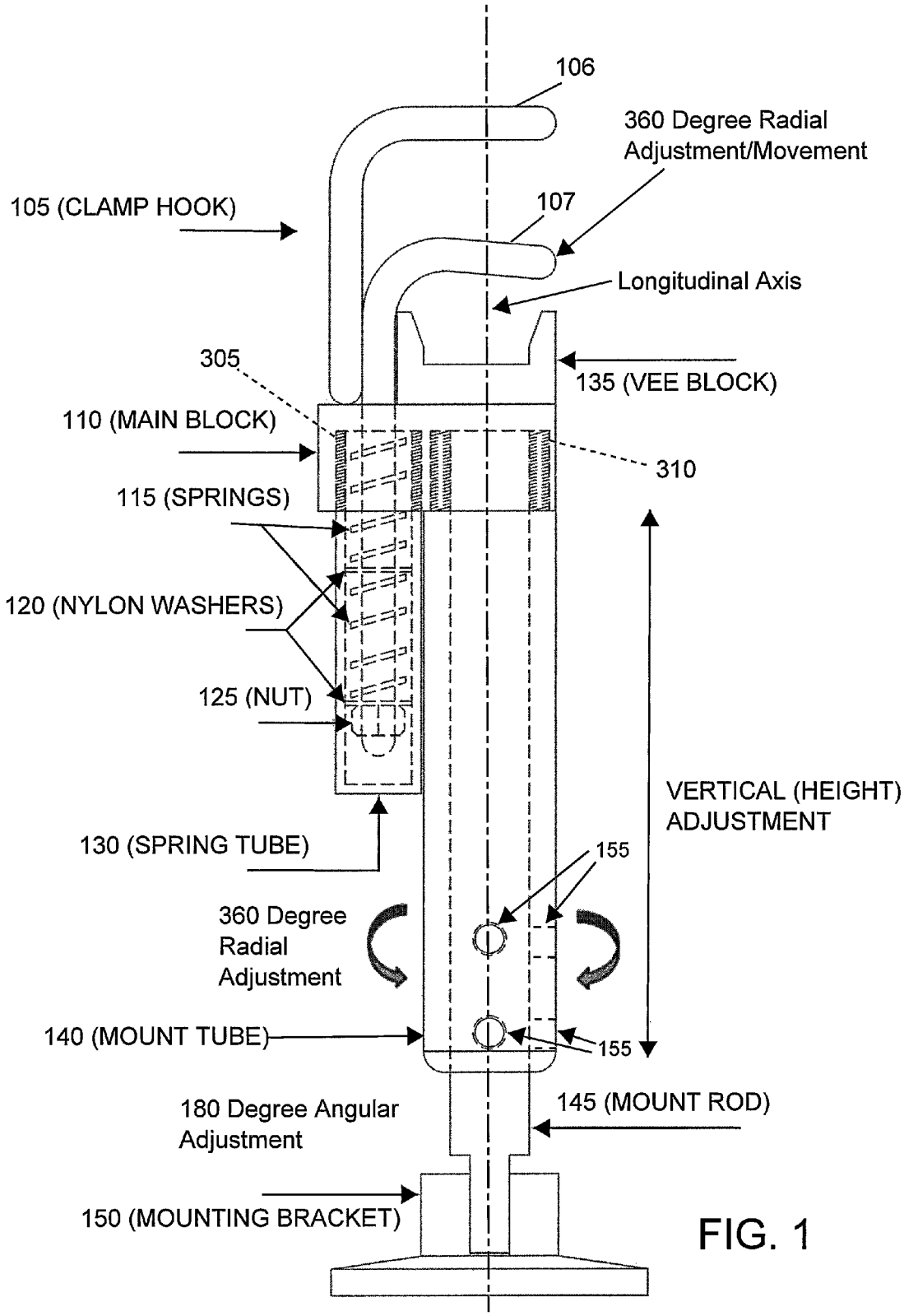
FIG. 1 is an assembly view of a trolling motor stabilizer mount according to an exemplary embodiment of this disclosure.

As briefly discussed in the background section, this disclosure is generally related to a support device for a trolling motor mounted to a boat while the trolling motor is in a retracted position, as compared to a deployed position. More specifically, a detachable spring loaded clamp operatively associated with the shaft of the trolling motor provides for a reduction in vibration and bouncing of the trolling motor shaft/arm while a boat is underway, which may be at a relatively high speed of travel, and/or while the boat is being trailered, etc.

Some advantages associated with the trolling motor stabilizer mount disclosed include:

- easily secures a boat's trolling motor arm when cruising through rough water;
- eliminates vibrations and bouncing of the trolling motor arm/trolling motor in rough water conditions;
- prevents the trolling motor unit from inadvertently deploying into the water when cruising, which could result in damage to the boat, boat motor, and/or trolling motor;
- holds the unit in place for safe transportation, i.e. trailering of the boat while underway on the water or roadways.

According to one exemplary embodiment of the disclosed trolling motor stabilizer mount, the mount is adjustable from any angle between 0°-180° at the mounting bracket attached to the boat, and the trolling motor stabilizer mount rotates radially 360° to provide a full spectrum of mounting configurations. A synthetic V-Channel safely cradles the trolling motor arm/shaft. While the disclosed embodiments and claims are not limited to a particular arm/shaft diameter, according to the exemplary embodiments described, a ⅞" to 1½" diameter arm is detachably clamped by the trolling motor stabilizer mount. Notably, the trolling motor stabilizer mount does not require any attachment to the trolling motor arm.

Before describing the details of the disclosed trolling motor stabilizer mount, provided is a list of features associated with various exemplary embodiments of the unit. The features described include a spring loaded locking unit; a horizontal adjustment; a vertical height adjustment and a radial adjustment. It is to be understood that exemplary embodiments of the trolling motor stabilizer mount may include a spring loaded locking unit with or without horizontal, vertical and/or radial adjustment. In addition, many of the components provided heretofore are described as being made of aluminum or stainless steel, however, it is to be understood the disclosed embodiments are not limited to specific materials, as a plurality of materials can be used to construct the trolling motor stabilizer mount disclosed. Some examples include plastic(s), synthetic materials, composite materials, various metals, etc.

Spring Loaded Locking Unit:

The spring loaded mechanism provided does not require the alignment of various pieces and parts to secure a trolling motor. Notably, this can be especially beneficial in rough water conditions. To operate the spring loaded locking unit, a boat operator simply lifts up on the stainless steel handle and rotates it over the arm of the trolling motor and then releases the stainless steel handle. A synthetic V-Channel safety cradles the arm and thick rubber adhesive covering the stainless steel hook attached to the rotated handle protects the trolling arm from scratching while providing a snug fit.

Horizontal Adjustment:

The body of the trolling motor stabilizer mount is adapted to adjust to any angle between 0° and 180°, relative to a mounting surface. The body is held in place by a pressure sensitive clamp operatively attaching the body to a mounting bracket. The pressure sensitive clamp allows the body to move freely when enough pressure is applied to it, yet the body stays locked in place when it is attached to the trolling motor arm. In other words, a fisherman can remove the trolling motor unit from the trolling motor stabilizer mount to deploy the trolling motor in the water. Then, the fisherman pushes on the mount to lay it down out of the way. When the fisherman desires to retract the trolling motor, the fisherman simply lifts up on the trolling motor mount body to lock the trolling motor in place using the spring loaded locking unit.

Vertical (Height) and Radial Adjustment:

The disclosed embodiments provide adjustment to a plurality of angles to accommodate various styles of boats and provide positioning of the unit to the exact height required for proper installation of the trolling motor stabilizer mount. An outer tube is positionable to a plurality of heights along a rod and the outer tube can rotate 360° to insure that the trolling motor arm fits precisely in the synthetic V-Channel. Once the unit is positioned vertically and radially, it can be locked in place by tightening four set screws.

While this disclosure is not limited to a particular size, examples include three different mounting sizes. Measurements indicated are from the bottom of the round mounting plate to the bottom of the trolling motor arm.

1. Standard Stabilizer Mount: Adjusts for any height from 6" to 8".

2. Medium Stabilizer Mount: Adjusts for any height from 8" to 12".

3. Large Stabilizer Mount: Adjusts for any height from 12" to 17".

With reference to FIG. 1, shown is an assembly view of a trolling motor stabilizer mount according to an exemplary embodiment of this disclosure.

The trolling motor stabilizer mount includes a trolling motor shaft support and a spring loaded clamp. More specifically, the trolling motor shaft support incudes a mounting bracket 150, a mount rod 145, a mount tube 140, fasteners 155, a main block 110 and a vee block 135. The spring loaded clamp includes a clamp hook 105 extending through a main block threaded hole 305, springs 115 and nylon washers 120, which are attached to the spring hook shaft using nut 125. Spring tube 130 is threaded into the main block threaded hole 305 and covers the clamp hook shaft, spring(s) 115, nylon washer(s) 120 and nut 125.

Figure 9:
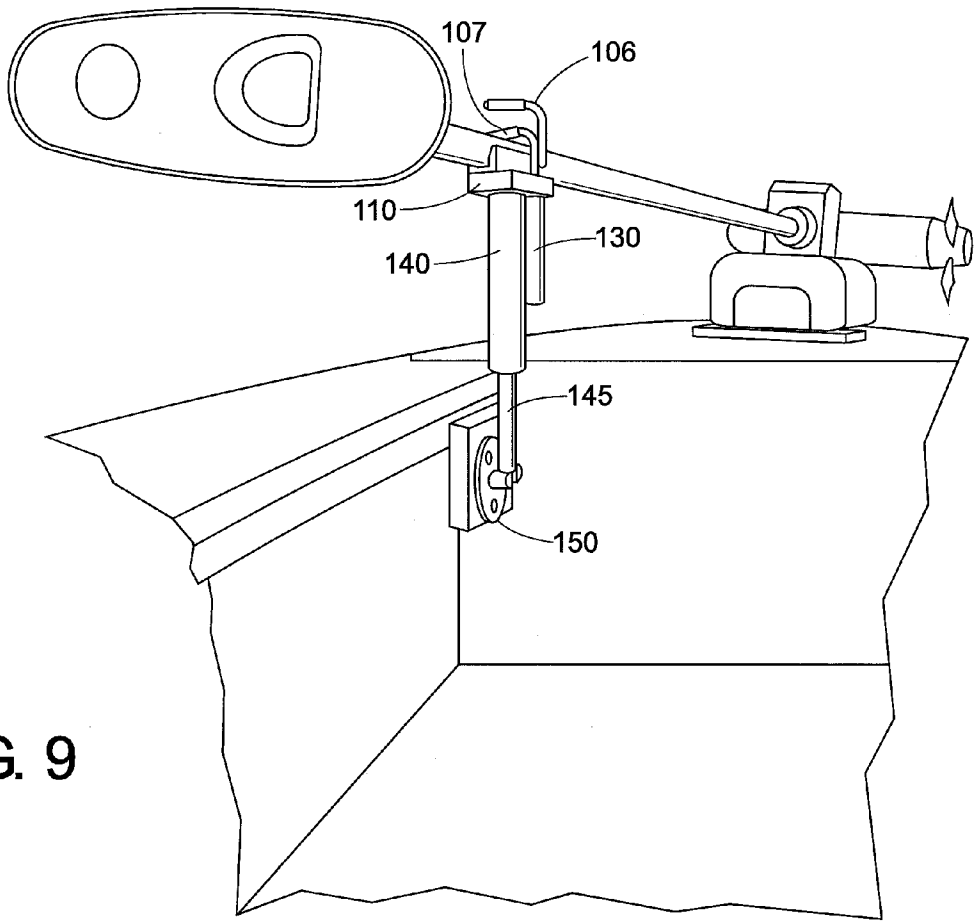
FIG. 9 is a first view of a bow mounted trolling motor in a retracted position and stabilized with a trolling motor stabilizer mount according to an exemplary embodiment of this disclosure.
Figure 10:
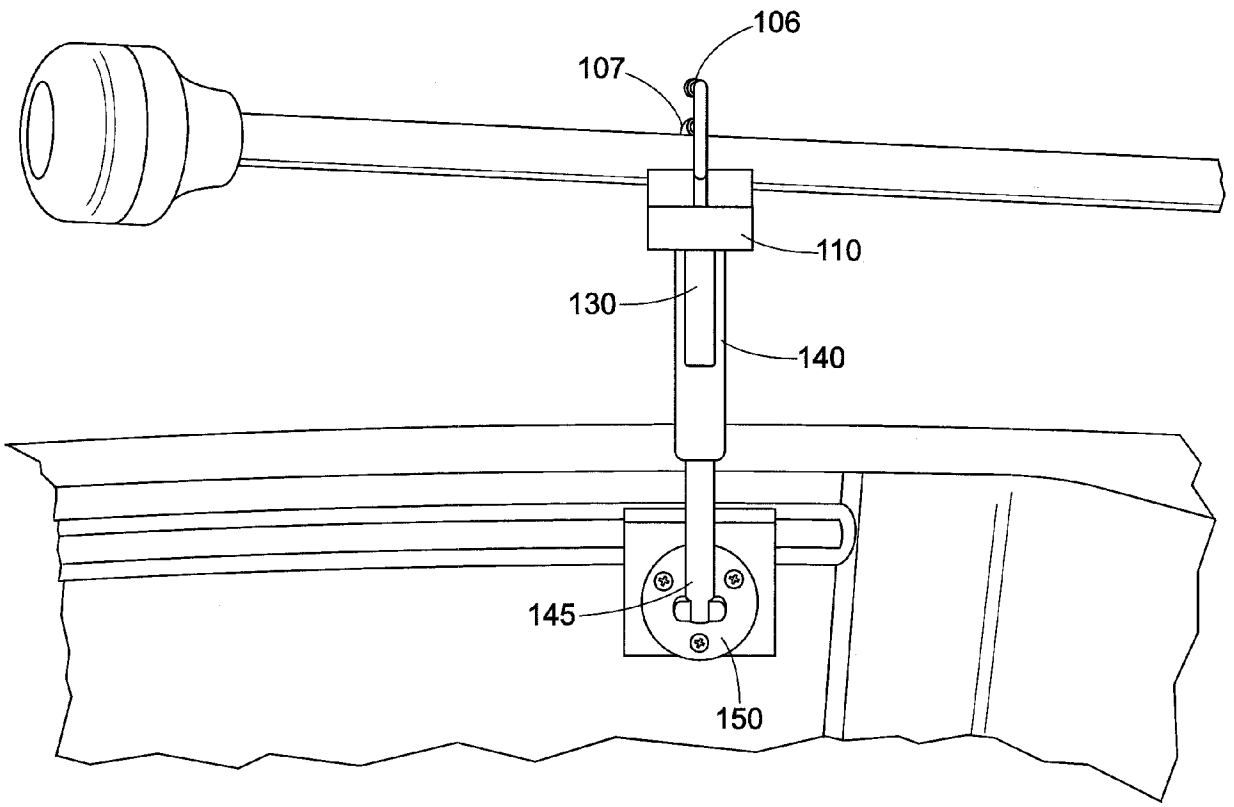
FIG. 10 is a second view of a bow mounted trolling motor in a retracted position and stabilized with a trolling motor stabilizer mount according to an exemplary embodiment of this disclosure.
Figure 12:
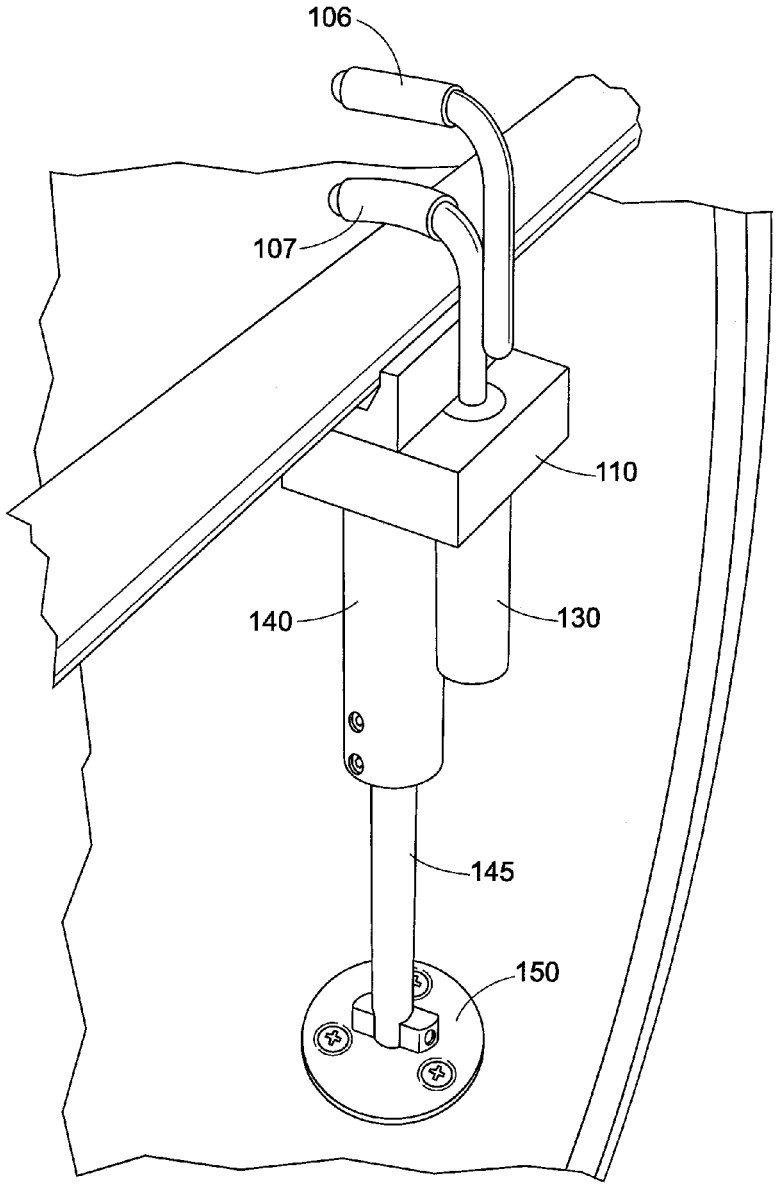
FIG. 12 is a view of a trolling motor stabilizer mount attached to the floor of a boat according to an exemplary embodiment of this disclosure.

In operation, as illustrated in FIGS. 9, 10 and 12, the vee block 135 provides support for the shaft of a retracted trolling motor during travel or nonuse of the trolling motor.

Further details of the trolling motor stabilizer mount include the following features.

The mount tube 140 is threaded into main block threaded hole 310.

The vee block 135 is attached to the top of the main block 110 and includes a V-Channel. The vee block is made of a synthetic material, according to one exemplary embodiment of this disclosure; however, other materials such as rubber, coated metals, plastics, etc. are within the scope of this disclosure.

Figure 11:
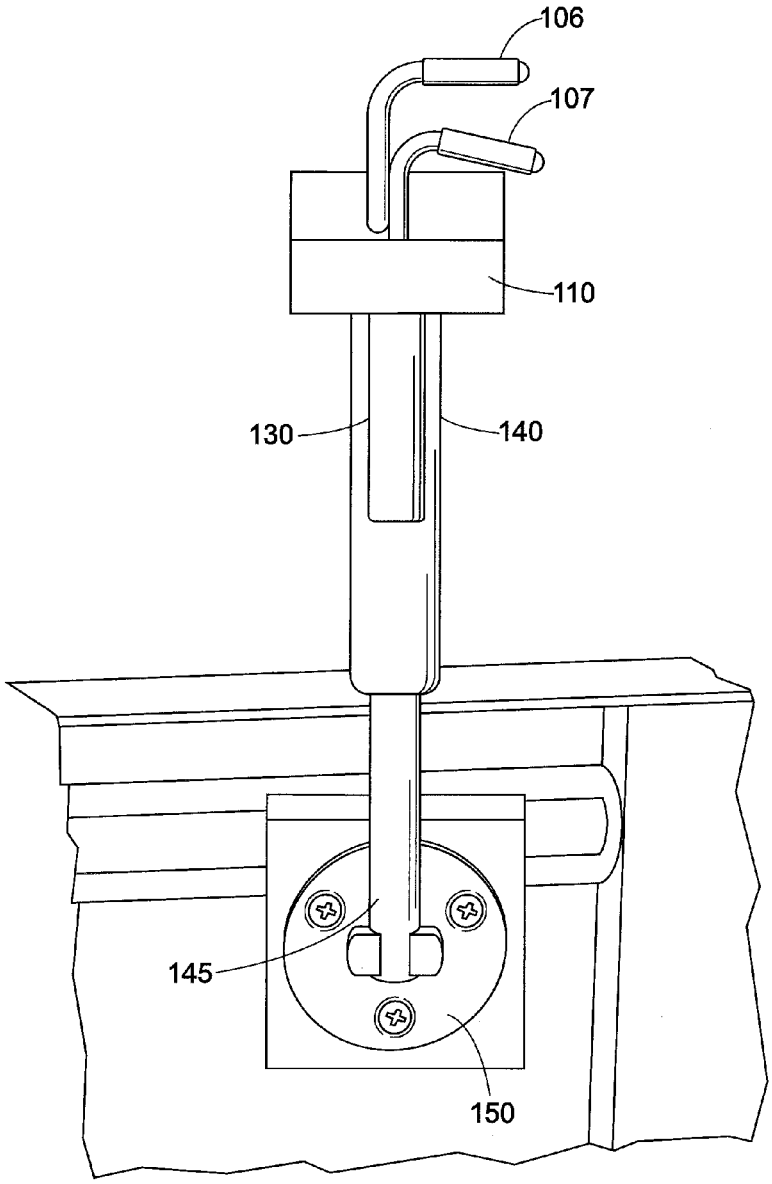
FIG. 11 is a third view of the trolling motor stabilizer mount shown in FIGS. 9 and 10, with the trolling motor attached.

The mounting bracket 150 and mount rod 145 are operatively connected in such a way as to provide 180° of angular adjustment to provide various mounting arrangements as illustrated in FIGS. 10, 11 and 12.

Vertical height adjustment of the trolling motor stabilizer mount is provided by the vertical positioning of the mount tube 140 along the mount rod 145. Fasteners 155 fix the mount tube 140 to the mount rod 145 at the desired vertical height.

The clamp hook 105 is rotatable 180° within the main block 110 and spring tube providing a manner of attaching/detaching the trolling motor shaft to/from the vee block 135. In operation, a user lifts up on the curved top piece of the clamp hook 105 and rotates the bottom curved piece 107 to the desired position.

It is to be understood that the trolling motor stabilizer mount illustrated in FIG. 1 and described is merely an exemplary embodiment. Other possible configurations of a trolling motor shaft support and associated spring loaded clamp are possible. For example, but not limited to, a basic trolling motor stabilizer mount which does not include one or more of the adjustment features previously described, a main block which is one or more pieces incorporating the functions of the vee block 135, mount tube 140, mount rod 145, mounting bracket 150 and/or spring tube 130.

With reference to FIGS. 2-8, provided are further details of the components of the trolling motor stabilizer mount illustrated in FIG. 1.

Figure 2:
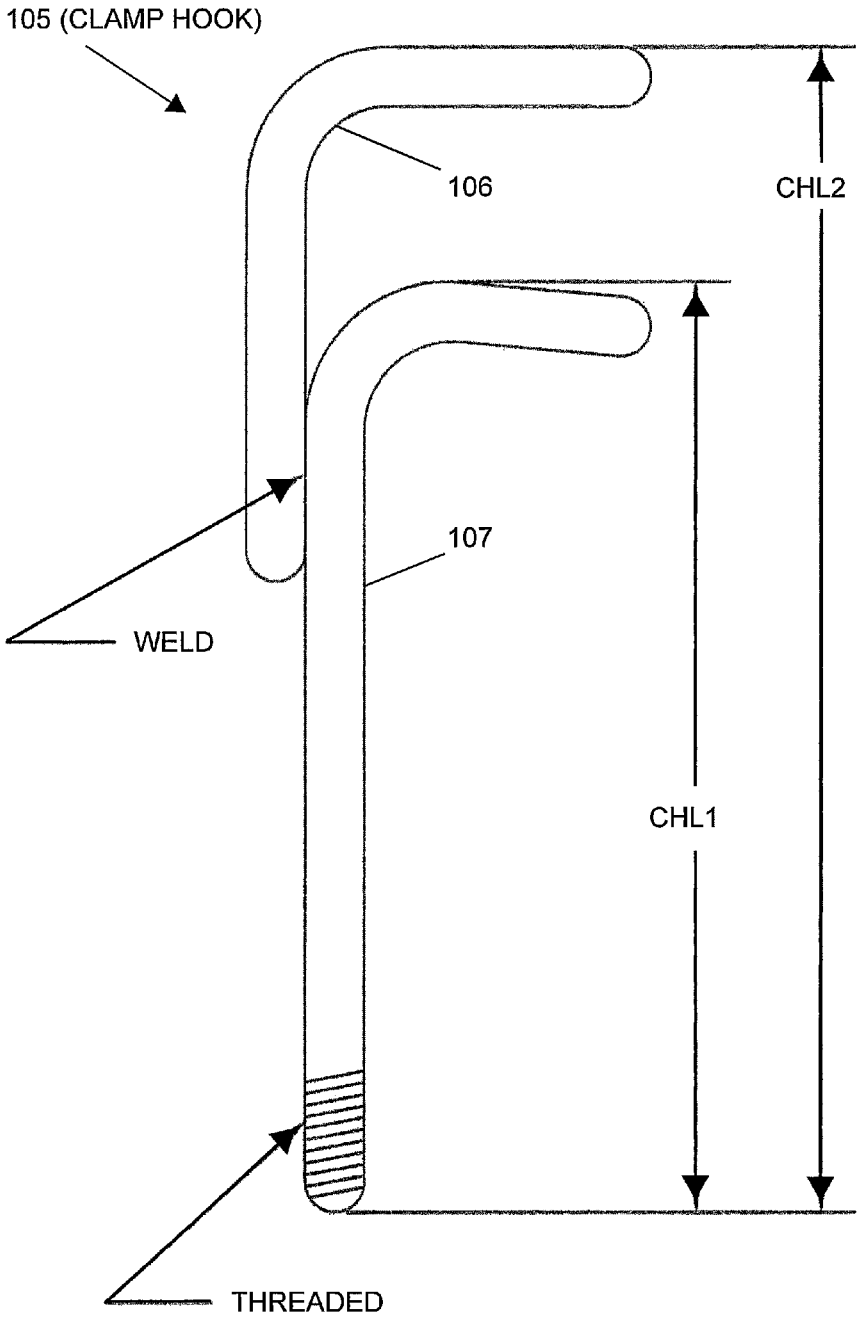
FIG. 2 is a detailed view of a clamp hook according to an exemplary embodiment of this disclosure.

With reference to FIG. 2, shown is a detailed view of a clamp hook 105 according to an exemplary embodiment of this disclosure.

As shown, the clamp hook 105 includes a top curved piece 106 and a bottom curved piece 107 which are welded together. A threaded portion of the bottom piece 107 provides a manner of fastening nut 125 as previously described with reference to FIG. 1. Dimensions associated with the clamp hook 105 include overall length CHL2 and bottom curved piece length CHL1. According to one exemplary embodiment, the clamp hook 105 is made of stainless steel, CHL1 is 4.5"-5.0" and CHL2 is 6.00"-6.50". Notably, CHL1 is sized to accommodate the diameter of the trolling motor shaft which will be attached to the vee block.

Figure 3B:
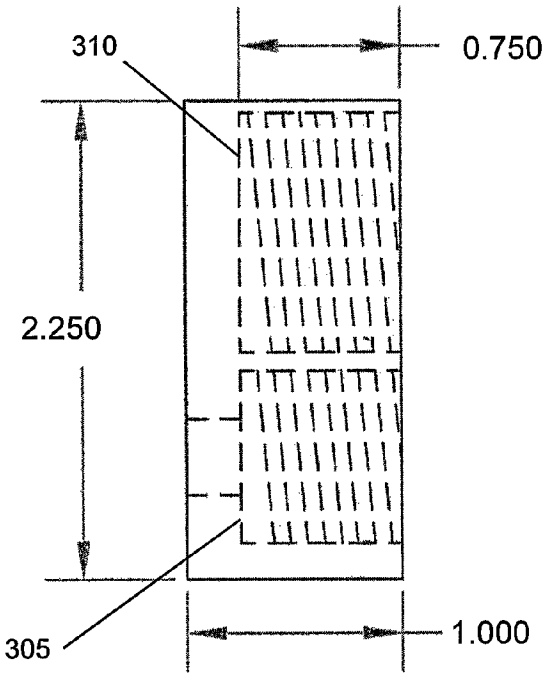
FIGS. 3A and 3B are detailed views of a main block according to an exemplary embodiment of this disclosure.
Figure 3A:
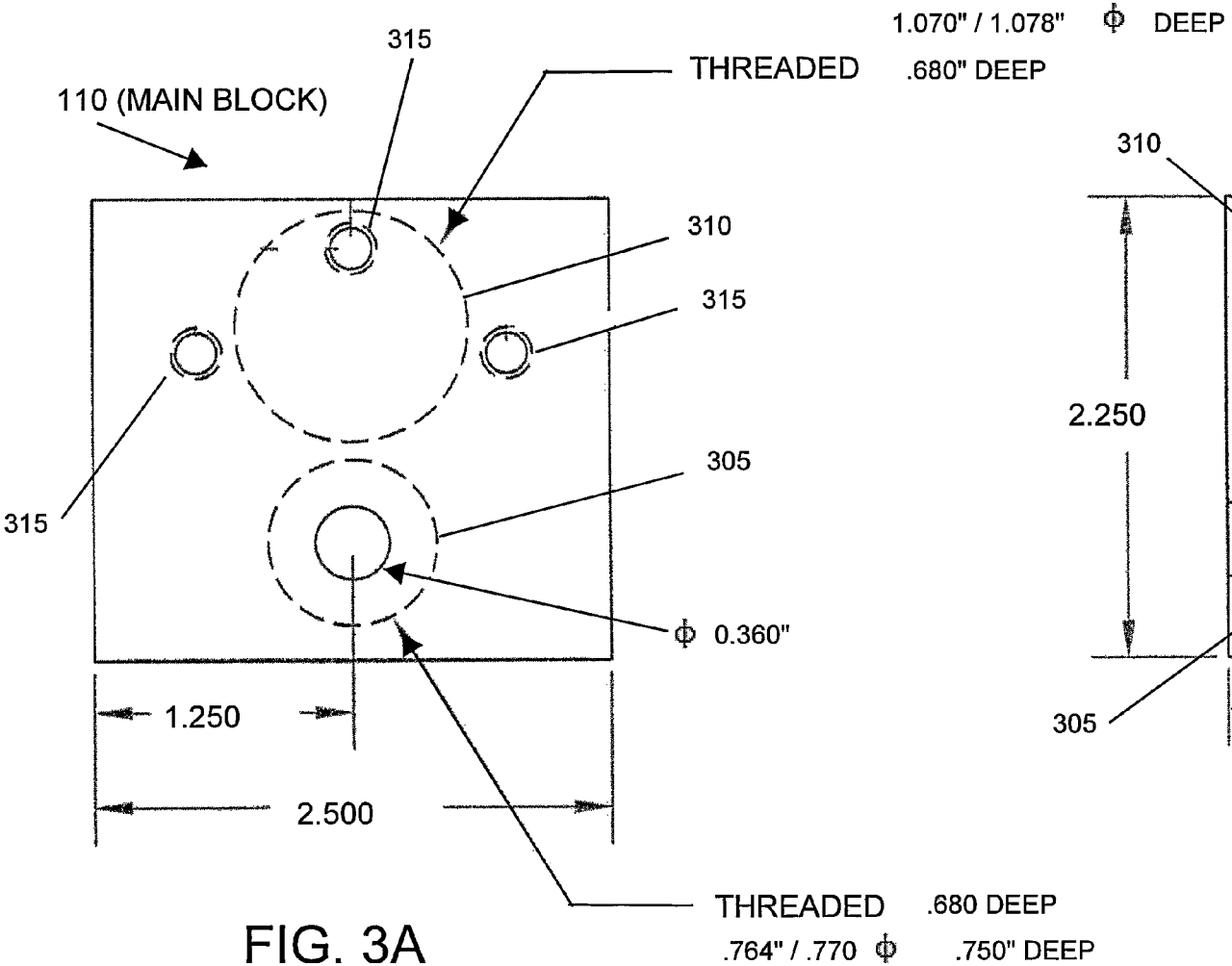

With reference to FIGS. 3A and 3B, shown are detailed views of a main block 110 according to an exemplary embodiment of this disclosure.

As shown, the main block 110 includes a feed through hole 305 which provides a pathway for the clamp hook 105 to extend through the main block 110. In addition, a second main block threaded hole 310 attaches to mount tube 140. As previously described, the mount rod 145/mount tube 140 arrangement provides vertical adjustment of the trolling motor stability mount. As shown in FIGS. 3A and 3B, main block threaded hole 310 may provide clearance for the mount rod 145 with the trolling motor stabilizer mount adjusted to its shortest height(s).

Three threaded holes 315 provide a manner of attaching the vee block 135 to the main block using threaded fasteners.

According to one exemplary embodiment, the dimensions of the main block 110 are approximately 2.5"×2.25"×1.0", as shown, and the threaded holes are sized as indicated.

Figure 4A:
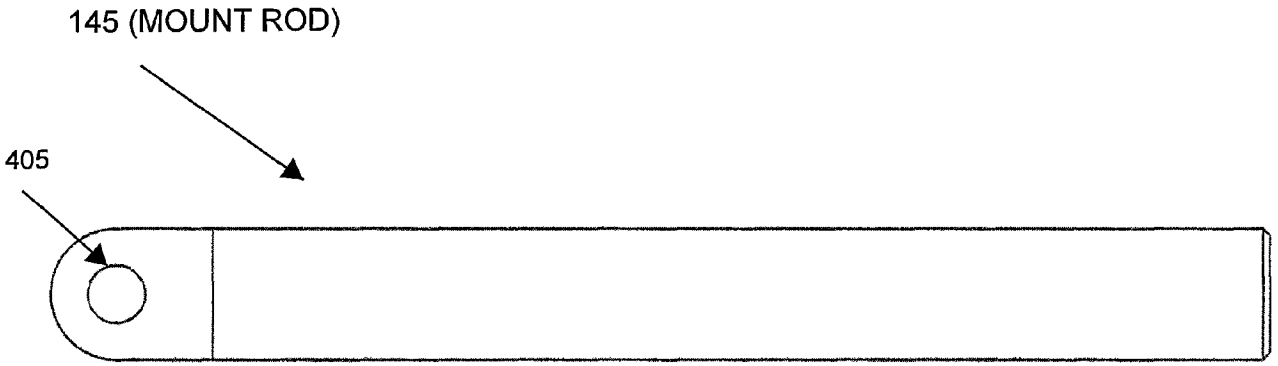
FIGS. 4A and 4B are detailed views of a mount rod according to an exemplary embodiment of this disclosure.
Figure 4B:
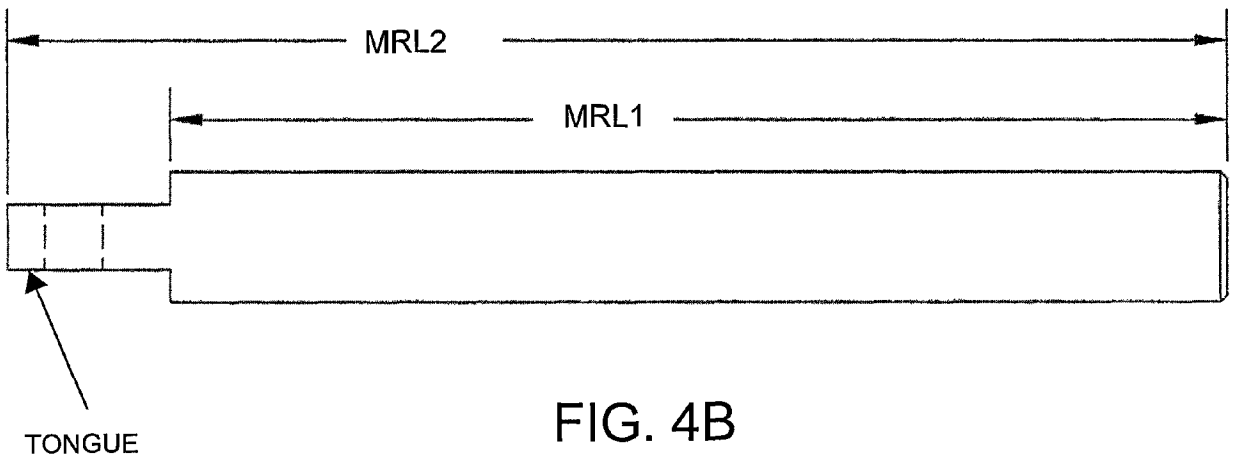

With reference to FIGS. 4A and 4B, shown are detailed views of a mount rod 145 according to an exemplary embodiment of this disclosure.

As shown, the mount rod includes a tongue with a hole 405 which is pivotably attached to the mounting plate of FIG. 1 using a friction bolt, according to one exemplary embodiment. This manner of attachment provides the mount rod 145 with 180 degrees of motion relative to the mounting plate.

According to one exemplary embodiment of this disclosure, MRL1 is 5.75"-6.25", MRL2 is 6.75"-7.25", hole 405 is 0.25"-0.50" in diameter and the mount rod 145 is approximately 0.750" in diameter and made of aluminum.

Figure 5:
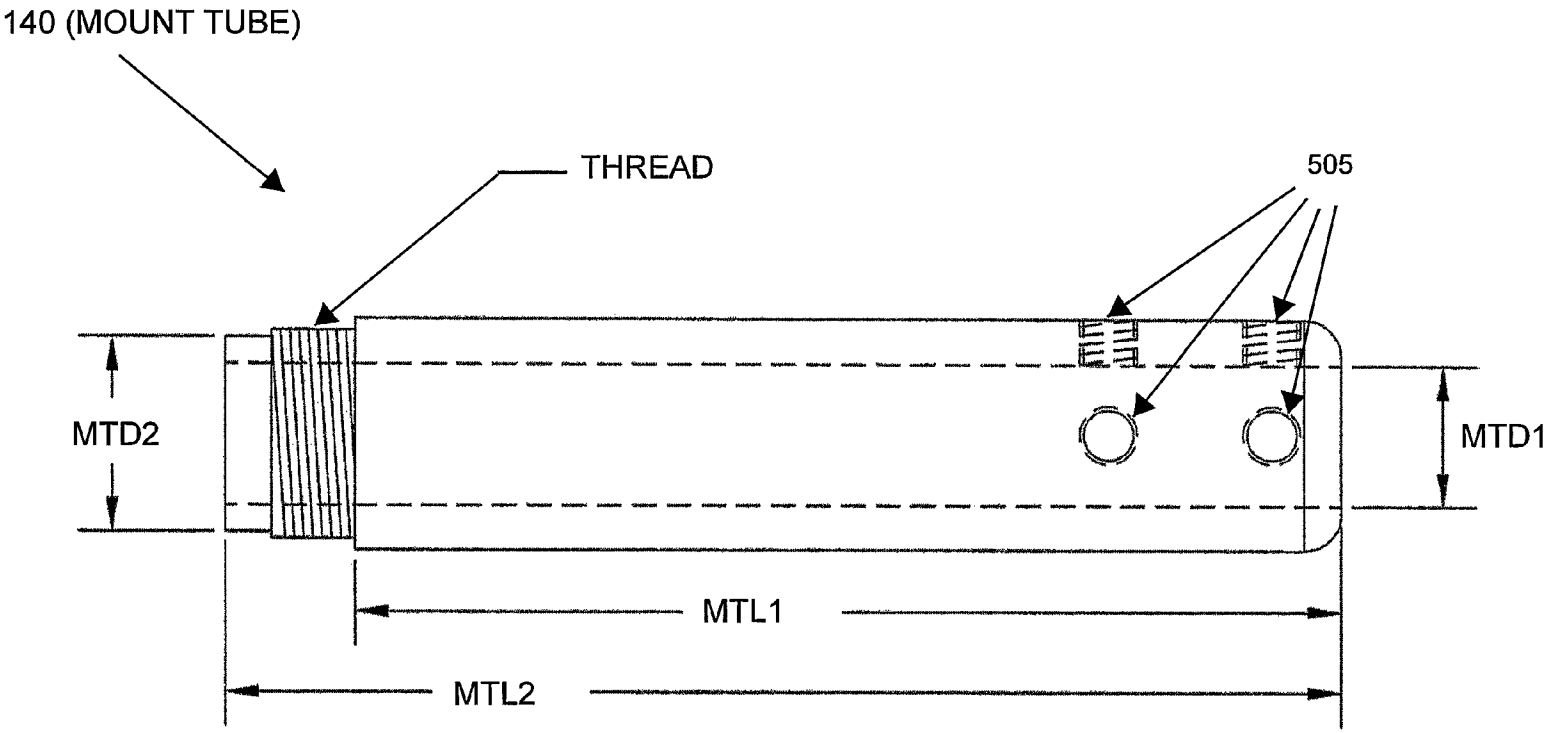
FIG. 5 is a detailed view of a mount tube according to an exemplary embodiment of this disclosure.

With reference to FIG. 5, shown is a detailed view of a mount tube 140 according to an exemplary embodiment of this disclosure.

The mount tube 140 includes threaded holes 505 to engage threaded fasteners 155 and attach the mount tube 140 to the mount rod 145 at the desired height as illustrated in FIG. 1. One end is sized at MTD2 and threaded to fasten to the main block 110. As shown, the mount tube 140 includes an inside chamber of diameter MTD1 which receives the mount rod 145.

According to one exemplary embodiment, MTD1 is approximately 0.75" in diameter, MTL1 is 5.00"-5.50", MTL2 is 5.75"-6.25", MTD2 is approximately 1.00" in diameter, and the tube is made of 1¼" diameter aluminum stock.

Figure 6B:
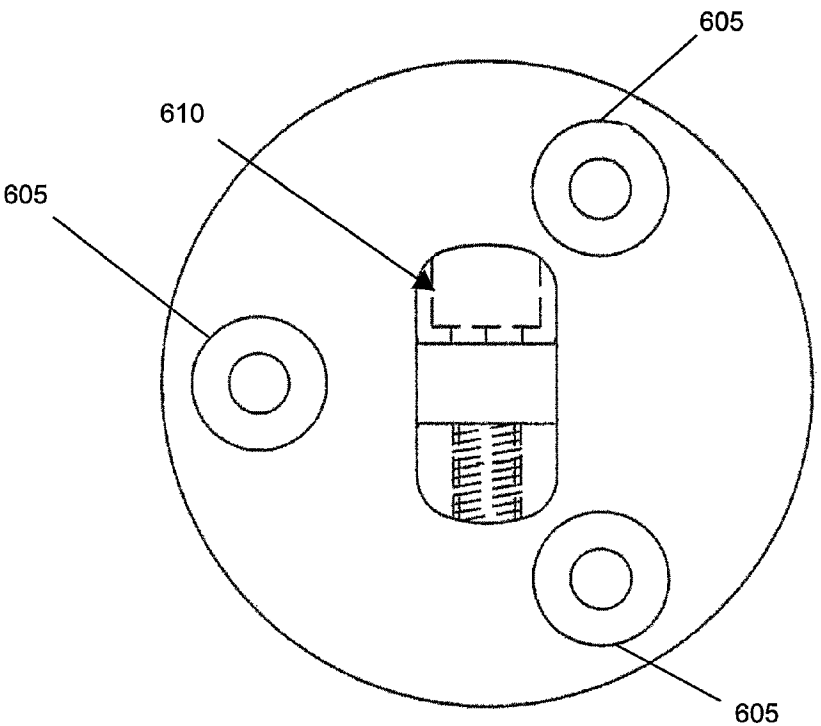
FIGS. 6A and 6B are detailed views of a boat mounting bracket according to an exemplary embodiment of this disclosure.
Figure 6A:
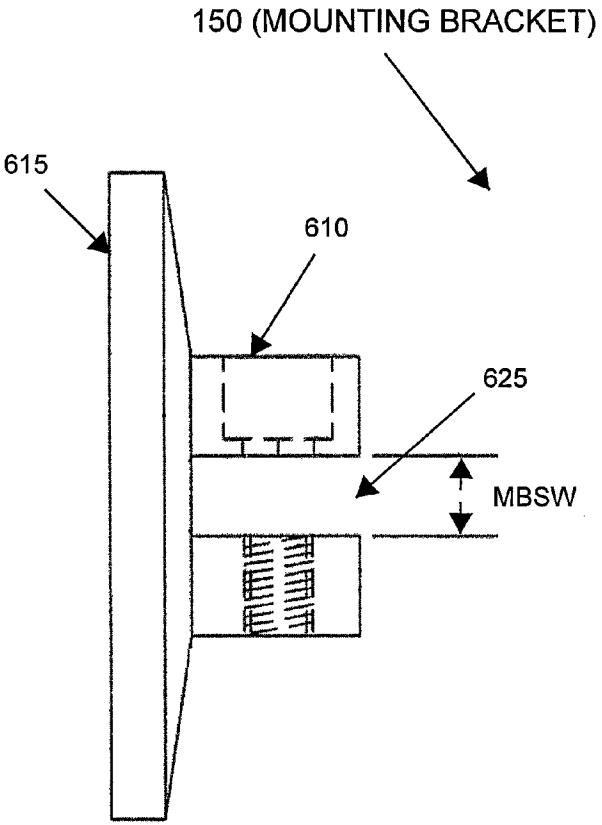

With reference to FIGS. 6A and 6B, shown are detailed views of a boat mounting bracket 150 according to an exemplary embodiment of this disclosure.

The mounting bracket 150 includes a base 615, mounting holes 605, a slot 625 to receive the tongue of the mount rod 145 and a threaded hole 610 to pivotably attach the mount rod 145 within the slot 625 using a friction type fastener.

According to one exemplary embodiment, the slot width MBSW is 0.35"-0.4", depending on the mount rod 145 tongue size and the mounting bracket is made of aluminum.

Figure 7:
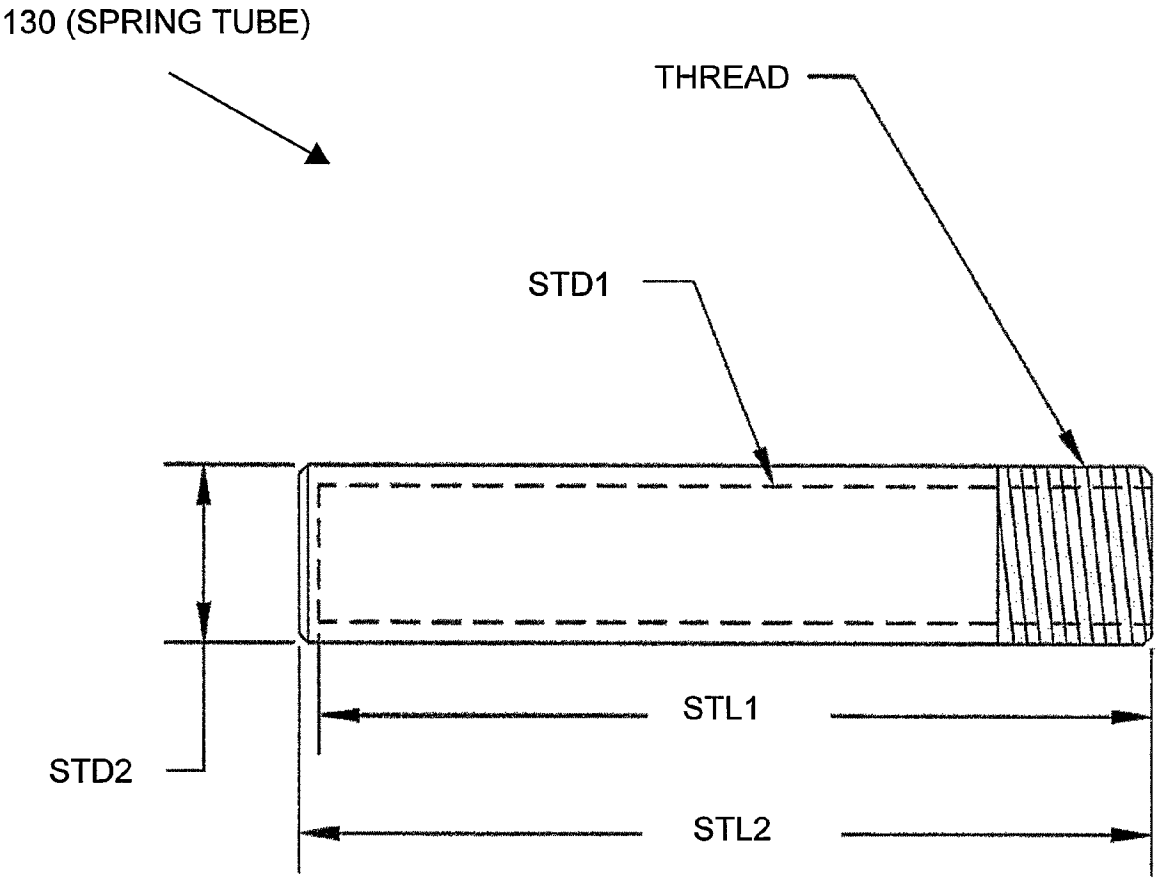
FIG. 7 is a detailed view of a spring tube according to an exemplary embodiment of this disclosure.

With reference to FIG. 7, shown is a detailed view of a spring tube according to an exemplary embodiment of this disclosure.

As shown, the spring tube 130 includes a threaded portion which attaches to the main block 110 and the spring tube 130 includes a hollow inner portion of diameter STD1 which houses the spring(s) 115, washer(s) 120 and nut 125.

According to one exemplary embodiment of this disclosure, STD1 is 0.5"-1.0" in diameter, STD2 is 0.75"-1.25" in diameter, STL1 is 3.5"-4", STL2 is 3.75"-4.25", and the spring tube is made of aluminum.

Figure 8B:
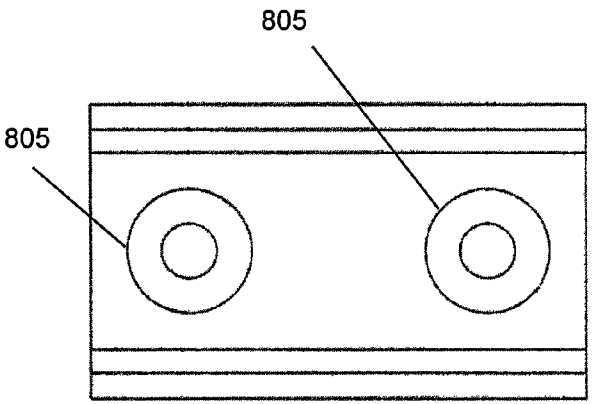
FIGS. 8A and 8B are detailed views of a vee block according to an exemplary embodiment of this disclosure.
Figure 8A:
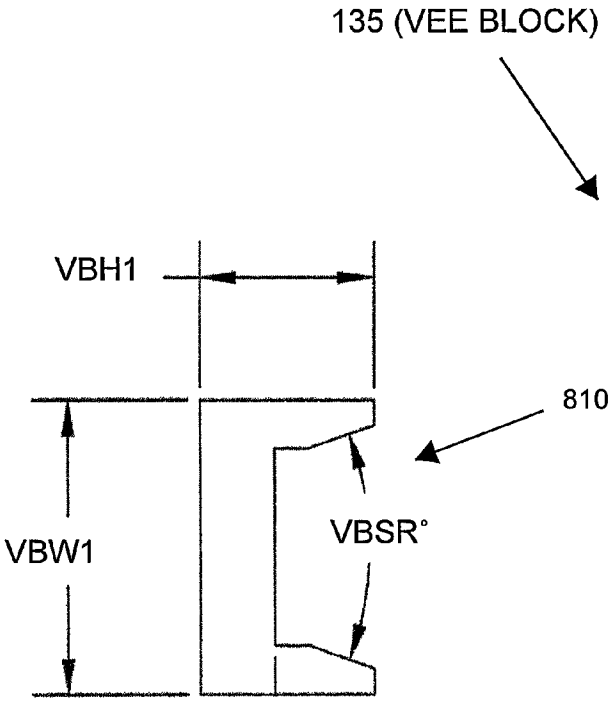

With reference to FIGS. 8A and 8B, shown are detailed views of a vee block 135 according to an exemplary embodiment of this disclosure.

As shown, the vee block 135 includes mounting holes 805 and a trolling motor support rest 810 with an opening angle of VBSR to support a trolling motor shaft.

According to one exemplary embodiment, VBH1 is 0.75" to 1.0", VBW1 is 1.75" to 2.0", and VBSR is 30° to 50°, preferably 40°.

While this disclosed exemplary embodiment includes a vee block made of a synthetic material, it is to be understood this is merely one example. The vee block 135 can be made of any suitable material, synthetic or natural, such as rubber, various plastics, coated aluminum or other metal, etc.

With reference to FIG. 9, shown is a first view of a bow mounted trolling motor in a retracted position and stabilized with a trolling motor stabilizer mount according to an exemplary embodiment of this disclosure.

As shown, the trolling motor stabilizer mount is adjusted to approximately a 0° position relative to the mounting plate and the lower curved piece of the clamp hook retains the shaft of the trolling motor in a fixed position.

With reference to FIG. 10, shown is a second view of a bow mounted trolling motor in a retracted position and stabilized with a trolling motor stabilizer mount according to an exemplary embodiment of this disclosure.

With reference to FIG. 11, shown is a third view of the trolling motor stabilizer mount shown in FIGS. 9 and 10, with the trolling motor attached.

With reference to FIG. 12, shown is a view of a trolling motor stabilizer mount attached to the floor of a boat according to an exemplary embodiment of this disclosure.

As shown, the trolling motor stabilizer mount is adjusted to approximately a 90° position relative to the mounting plate and the lower curved piece of the clamp lock retains the shaft of the trolling motor in a fixed position.

Figure 13:
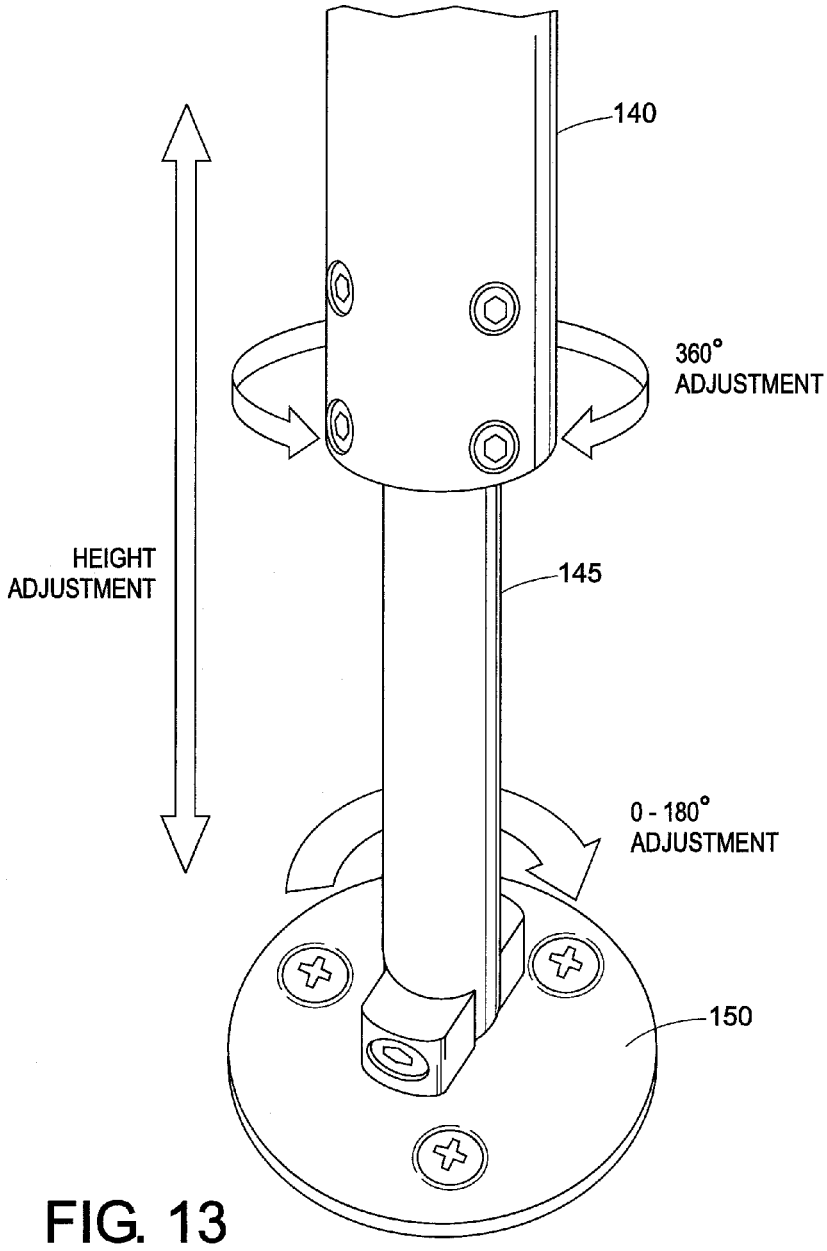
FIG. 13 is a partial view of a trolling motor stabilizer mount according to an exemplary embodiment of this disclosure, showing adjustment features of the mount.

With reference to FIG. 13, shown is a partial view of a trolling motor stabilizer mount according to an exemplary embodiment of this disclosure, showing adjustment features of the mount as previously described.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

The invention claimed is:

1. A trolling motor stabilizer mount comprising:

a trolling motor shaft support including a first longitudinal end and a second longitudinal end defined by a longitudinal axis passing through the first and second longitudinal ends, the first longitudinal end adapted to mount to a boat and the second longitudinal end adapted to provide a rest for a shaft associated with a retracted trolling motor;

a main block assembly associated with the trolling motor shaft support, the main block including a clamp hole extending through the main block; and a spring loaded clamp operatively associated with the shaft support second longitudinal end and adapted to releasably engage the shaft associated with the retracted trolling motor, the spring loaded clamp including:

a spring axially aligned along the shaft support longitudinal axis;

a clamp including a shaft extending through the clamp hole and the spring; and a spring cover adapted to cover the spring and all or a portion of the clamp shaft.

2. The trolling motor stabilizer mount according to claim 1, wherein the spring is aligned parallel and offset to the shaft support longitudinal axis.

3. The trolling motor stabilizer mount according to claim 1, wherein the spring is substantially in-line with the shaft support longitudinal axis.

4. The trolling motor stabilizer mount according to claim 1, wherein the retracted trolling motor is mounted in proximity to a bow of the boat or in proximity to a stern of the boat.

5. The trolling motor stabilizer mount according to claim 1, wherein the trolling motor is deployable and retractable.

6. The trolling motor stabilizer mount according to claim 1, the trolling motor shaft support comprising:

a vee block attached to the main block to provide the second longitudinal end of the support, and the vee block adapted to provide a substantially v shaped rest for the shaft associated with the retracted trolling motor; and the spring loaded clamp comprising:

a fastener attached to the clamp hook shaft to hold the spring at a desired position.

7. The trolling motor stabilizer mount according to claim 6, wherein the clamp hook hole and the spring cover are attached by threads.

8. The trolling motor stabilizer mount according to claim 6, wherein the vee block is made of a plastic material.

9. The trolling motor stabilizer mount according to claim 6, wherein the clamp hook includes a top curved piece and a bottom curved piece associated with the clamp hook shaft, and the clamp hook is adapted to be liftable and rotatable 360° independent from the trolling motor support.

10. The trolling motor stabilizer mount according to claim 6, wherein the vee block is adapted to provide a v shaped rest with an opening angle in the range of 0° to 180°.

11. The trolling motor stabilizer mount according to claim 6, the trolling motor shaft support comprising:

a mounting bracket adapted to attach to the boat;

a mount rod pivotably attached to the mounting bracket; and a mount tube adapted to attach to the main block and cover the mount rod, the mount tube adapted to provide vertical height adjustment of the main block relative to the mounting bracket and mount rod.

12. The trolling motor stabilizer mount according to claim 11, wherein the mount tube and main block are adapted to be attached by threads.

13. The trolling motor stabilizer mount according to claim 11, wherein the mount tube includes one or more fasteners to fix the height of the mount tube relative to the mounting bracket and mount rod by fastening the mount tube to the mount rod.

14. The trolling motor stabilizer mount according to claim 13, wherein the mount tube rotates 360° radially relative to the mount rod.

15. The trolling motor stabilizer mount according to claim 1, wherein the spring loaded clamp includes two or more springs axially aligned along the shaft support longitudinal axis.

16. The trolling motor stabilizer mount according to claim 15, wherein the two or more springs includes a first spring and a second spring, and the spring loaded clamp includes one or more washers axially aligned along the shaft support longitudinal axis, the one or more washers operatively engaging an inside surface of the spring cover to guide a movement of the shaft.

17. The trolling motor stabilizer mount according to claim 1, wherein the spring cover is tube shaped.

18. A trolling motor stabilizer mount comprising:

a trolling motor shaft support including a first longitudinal end and a second longitudinal end defined by a longitudinal axis passing through the first and second longitudinal ends, the first longitudinal end adapted to mount to a boat and the second longitudinal end adapted to provide a rest for a shaft associated with a retracted trolling motor and, the trolling motor shaft support including:

a main block operatively associated with the trolling motor shaft support, the main block including a clamp hook hole;

a vee block attached to the main block to provide the second longitudinal end of the support, and the vee block adapted to provide a substantially v shaped rest for the shaft associated with the retracted trolling motor;

a spring loaded clamp operatively associated with the shaft support second longitudinal end and adapted to releasably engage the shaft associated with the retracted trolling motor, the spring loaded clamp including a spring axially aligned along the shaft support longitudinal axis, wherein the spring is aligned parallel and offset to the shaft support longitudinal axis, the spring loaded clamp including:

the spring;

a clamp hook including a shaft extending through the clamp hook hole and the spring, and a fastener attached to the clamp hook shaft to hold the spring at a desired position; and a spring cover adapted to cover the spring and clamp hook shaft, wherein the clamp hook hole and the spring cover are attached by threads, the vee block is made of a plastic material, and the clamp hook includes a top curved piece and a bottom curved piece associated with the clamp hook shaft, and the clamp hook is liftable and rotatable 180° independent from the trolling motor support.

19. The trolling motor stabilizer mount according to claim 18, the trolling motor shaft support comprising:

a mounting bracket adapted to attach to the boat;

a mount rod pivotably attached to the mounting bracket; and a mount tube adapted to attach to the main block and cover the mount rod, the mount tube adapted to provide vertical height adjustment of the main block relative to the mounting bracket and mount rod.

20. The trolling motor stabilizer mount according to claim 19, wherein the mount tube and main block are adapted to be attached by threads, the mount tube includes one or more fasteners to fix the height of the mount tube relative to the mounting bracket and mount rod by fastening the mount tube to the mount rod, and the mount tube radial rotates 360° relative to the mount rod.

* * * * *